US008028351B2

(12) United States Patent
Stachler et al.

(10) Patent No.: US 8,028,351 B2
(45) Date of Patent: Oct. 4, 2011

(54) PROTECTIVE GARMENTS AND GASKET SYSTEM FOR FIREFIGHTER'S AND OTHER EMERGENCY PERSONNEL

(75) Inventors: Thomas H. Stachler, Dayton, OH (US); William L. Grilliot, West Milton, OH (US); William L. Grilliot, Jr., Dayton, OH (US)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 12/398,370

(22) Filed: Mar. 5, 2009

(65) Prior Publication Data

US 2010/0223712 A1 Sep. 9, 2010

(51) Int. Cl.
*A41D 13/02* (2006.01)
*A41D 27/00* (2006.01)
*A41D 13/00* (2006.01)

(52) U.S. Cl. ..... 2/457; 2/455; 2/458; 2/456

(58) Field of Classification Search ..... 2/455, 456, 2/457, 458, 2.11–2.17, 16, 17, 22, 23, 60, 2/81, 311–322
See application file for complete search history.

(56) References Cited

U.S. PATENT DOCUMENTS 413,149 A * 10/1889 Rexer et al. ..... 36/1.5
869,177 A * 10/1907 Hathaway ..... 36/1.5
1,670,213 A * 5/1928 Ribichon ..... 2/79
1,896,183 A * 2/1933 Manson ..... 2/79
2,274,270 A * 2/1942 Kalb ..... 2/227
2,596,112 A * 5/1952 Aines ..... 2/232
2,730,723 A * 1/1956 Jonsson ..... 2/270
2,786,208 A * 3/1957 Oberg ..... 2/232
2,813,272 A * 11/1957 Hagan ..... 285/260
3,268,914 A * 8/1966 Esther ..... 2/227
3,312,982 A * 4/1967 Pitman ..... 2/232
3,411,160 A * 11/1968 Le Roux et al. ..... 2/232
3,671,975 A * 6/1972 Vorsteher ..... 2/232
3,758,890 A * 9/1973 Selzer ..... 2/232
4,064,641 A * 12/1977 Levine ..... 36/1.5
4,458,363 A * 7/1984 Harvey ..... 2/2.11
4,509,213 A * 4/1985 Harvey ..... 2/22

(Continued)

OTHER PUBLICATIONS

U.S. Appl. No. 10/999,437, filed Nov. 30, 2004, Grilliot et al.

(Continued)

*Primary Examiner* — Bobby Muromoto, Jr.
(74) *Attorney, Agent, or Firm* — Wood, Phillips, Katz, Clark & Mortimer

(57) ABSTRACT

A gasket system (18) is provided for use with a protective boot (12) and a pant leg (16) of a protective garment (14) for a firefighter or other emergency worker. The boot (12) includes an outer boot (24) and a moisture/vapor barrier liner (26), and the leg (16) includes an outer shell (20) and a moisture/vapor barrier liner (22). The gasket system (18) includes a first gasket (30) fixed to the liner (22) of the pant leg (16) and defining a first annular interlock (34) to encircle a wearer's leg received in the pant leg (16), and a second gasket (32) fixed to at least one of the outer boot (24) and the boot liner (26) and defining a second annular interlock (36) to encircle a wearer's leg received in the boot (12). The first and second interlocks (34,36) are engageable with each other to form a seal with a leg received in both the boot (12) and the pant leg (16).

23 Claims, 1 Drawing Sheet

U.S. PATENT DOCUMENTS

| | | | | | |
|---|---|---|---|---|---|
| 4,543,670 | A | * | 10/1985 | Ehring | 2/85 |
| 4,773,100 | A | * | 9/1988 | Kuo | 2/46 |
| 4,791,685 | A | * | 12/1988 | Maibauer | 2/227 |
| 4,817,211 | A | * | 4/1989 | Grilliot et al. | 2/227 |
| 4,858,342 | A | * | 8/1989 | Nicholson et al. | 36/109 |
| 4,864,742 | A | * | 9/1989 | Grilliot et al. | 36/109 |
| 5,005,216 | A | * | 4/1991 | Blackburn et al. | 2/79 |
| 5,022,096 | A | * | 6/1991 | Pacanowsky | 2/227 |
| 5,058,208 | A | * | 10/1991 | Adams | 2/80 |
| 5,090,057 | A | * | 2/1992 | Aldridge | 2/82 |
| 5,131,098 | A | * | 7/1992 | Grilliot et al. | 2/227 |
| 5,208,919 | A | * | 5/1993 | Fields | 2/123 |
| 5,282,277 | A | * | 2/1994 | Onozawa | 2/69 |
| RE34,662 | E | * | 7/1994 | Keller | 2/82 |
| 5,611,082 | A | * | 3/1997 | Bull | 2/79 |
| RE35,682 | E | * | 12/1997 | Fields | 2/123 |
| 5,787,502 | A | * | 8/1998 | Middleton | 2/69 |
| 6,134,717 | A | * | 10/2000 | Grilliot et al. | 2/227 |
| 6,311,412 | B1 | * | 11/2001 | Grilliot et al. | 36/10 |
| 6,665,880 | B2 | * | 12/2003 | Poppe | 2/114 |
| 7,069,670 | B1 | * | 7/2006 | Gerke | 36/2 R |
| 7,461,468 | B2 | * | 12/2008 | Grilliot et al. | 36/10 |
| 2002/0121747 | A1 | * | 9/2002 | Kolodziej et al. | 277/644 |
| 2003/0070211 | A1 | * | 4/2003 | Crye et al. | 2/457 |
| 2003/0188368 | A1 | * | 10/2003 | Stinton | 2/2.16 |

OTHER PUBLICATIONS

U.S. Appl. No. 11/525,619, filed Sep. 22, 2006, Grilliot et al.

* cited by examiner

PROTECTIVE GARMENTS AND GASKET SYSTEM FOR FIREFIGHTER'S AND OTHER EMERGENCY PERSONNEL

FEDERALLY SPONSORED RESEARCH OR DEVELOPMENT

This invention was made with Government support under Contract No. W91CRB-04-C-027 awarded by the United States Department of the Army. The Government has certain rights in the invention.

CROSS-REFERENCE TO RELATED APPLICATIONS

Not Applicable.

MICROFICHE/COPYRIGHT REFERENCE

Not Applicable.

FIELD OF THE INVENTION

This invention pertains to protective garments for firefighter's and other emergency responders, such as, for example, protective coats, trousers, overalls, coveralls, boots, and gloves, and in more particular applications, to pant legs of such garments and protective boots.

BACKGROUND OF THE INVENTION

Commonly, firefighters and other emergency rescue workers wear protective garments in which the distal margins of the pant legs of the protective garments may fit loosely over protective boots. Such loosely fitting margins do not effectively inhibit the ingress of potentially harmful materials, whether gaseous, liquid, or particulate. Several possible solutions to this challenge are shown in U.S. Pat. No. 6,134,717 to William L. Grilliot et al, issued Oct. 24, 2000, entitled "Protective Garment With Leg Portions and With Cuffs to Prevent Liquids from Entering Boots", U.S. Ser. No. 10/999,437 to William L. Grilliot et al, filed Nov. 30, 2004, entitled "Protective Garments Having Elastomeric Gaskets Along Margins to Inhibit Ingress of Potentially Harmful Materials" and U.S. Ser. No. 11/525,619 to William L. Grilliot et al, filed Sep. 22, 2006, entitled "Protective Garment Wearable with Boots and Comprising Attached Socks", the entire disclosures of which are incorporated herein by reference. While each of the foregoing may work well for their intended purpose, there is always room for improvement.

SUMMARY OF THE INVENTION

In accordance with one feature of the invention, a gasket system is provided for use with a protective boot and a pant leg of a protective garment for a firefighter or other emergency worker, the boot including an outer boot and a moisture/vapor barrier liner, and the leg including an outer shell and a moisture/vapor barrier liner. The gasket system includes a first gasket fixed to the liner of the pant leg and defining a first annular interlock to encircle a wearer's leg received in the pant leg; and a second gasket fixed to at least one of the outer boot and the boot liner and defining a second annular interlock to encircle a wearers leg received in the boot. The first and second interlocks are engageable with each other to form a seal with a leg received in both the boot and the pant leg.

As one feature, the second gasket is fixed to the boot liner.

According to one feature, the second gasket is fixed to the outer boot.

In one feature, the first annular interlock includes a downwardly facing annular channel that receives the second annular interlock.

According to one feature, the first annular interlock includes an upwardly facing annular shoulder engageable with a downwardly facing annular shoulder of the second annular interlock to maintain engagement between the first and second gaskets. As a further feature, the annular shoulders are defined by frustoconical surfaces.

As one feature, the gasket system further includes releasable fasteners on the pant leg and the boot to maintain engagement of the first and second gaskets.

In accordance with one feature of the invention, a protective combination is provided for use by a firefighter or other emergency worker. The combination includes a pant leg of a protective garment and a protective boot. The pant leg includes an outer shell for encasing a leg of a wearer, a moisture/vapor barrier liner for encasing the leg of a wearer and surrounded by the outer shell, and a first gasket fixed to the liner to encircle the leg of a wearer. The boot includes an outer boot, a moisture/vapor barrier liner within the outer boot, and a second gasket fixed to at least one of the outer boot and the liner of the boot to encircle the leg of a wearer. The first and second gaskets define interlocking, conforming annular surfaces that form a seal with the first and second gaskets engaged to each other.

As one feature, the first gasket includes a downwardly facing annular channel that receives an upwardly directed annular bead of the second gasket, the channel and the bead defining the annular surface.

In one feature, the annular surfaces include an upwardly facing annular shoulder surface on the first gasket and a downwardly facing annular shoulder surface on the second gasket, with the shoulder surfaces interlocking to maintain engagement between the first and second gaskets. As a further feature, the shoulder surfaces are frustoconical surfaces.

According to one feature, the combination further includes releasable fasteners on the pant leg and the boot to maintain engagement of the first and second gaskets.

In accordance with one feature, a protective combination is provided for use by a firefighter or other emergency worker. The combination includes a pant leg of a protective garment and a protective boot. The pant leg includes an outer shell for encasing a leg of a wearer, a moisture/vapor barrier liner for encasing the leg of a wearer, the liner surrounded by the outer shell, and a first rubber gasket fixed to the liner to encircle the leg of a wearer. The boot includes an outer boot, a moisture/vapor barrier liner within the outer boot, and a second rubber gasket fixed to at least one of the outer boot and the liner of the boot to encircle the leg of a wearer. The first and second gaskets engage with each other to form a seal with a leg received in the pant leg and the boot.

In one feature, the first and second gaskets include annular seal surfaces that engage each other to form the seal.

As one feature, the first and second gaskets include interlocking shoulders that engage against each other to maintain engagement of the first and second gaskets.

According to one feature, the first gasket includes a downwardly facing annular channel and the second gasket includes an upwardly facing bead interlocked in the channel to maintain engagement of the first and second gaskets.

As one feature, the first and second gaskets include engageable interlocks to maintain engagement of the first and second gaskets.

In one feature, the combination further includes releasable fasteners on the pant leg and the boot to maintain engagement of the first and second gaskets.

Other objects, features, and advantages of the invention will become apparent from a review of the entire specification, including the appended claims and drawings.

DETAILED DESCRIPTION OF THE PREFERRED EMBODIMENT

Figures 1, 2, 3, 4, 5, 6:
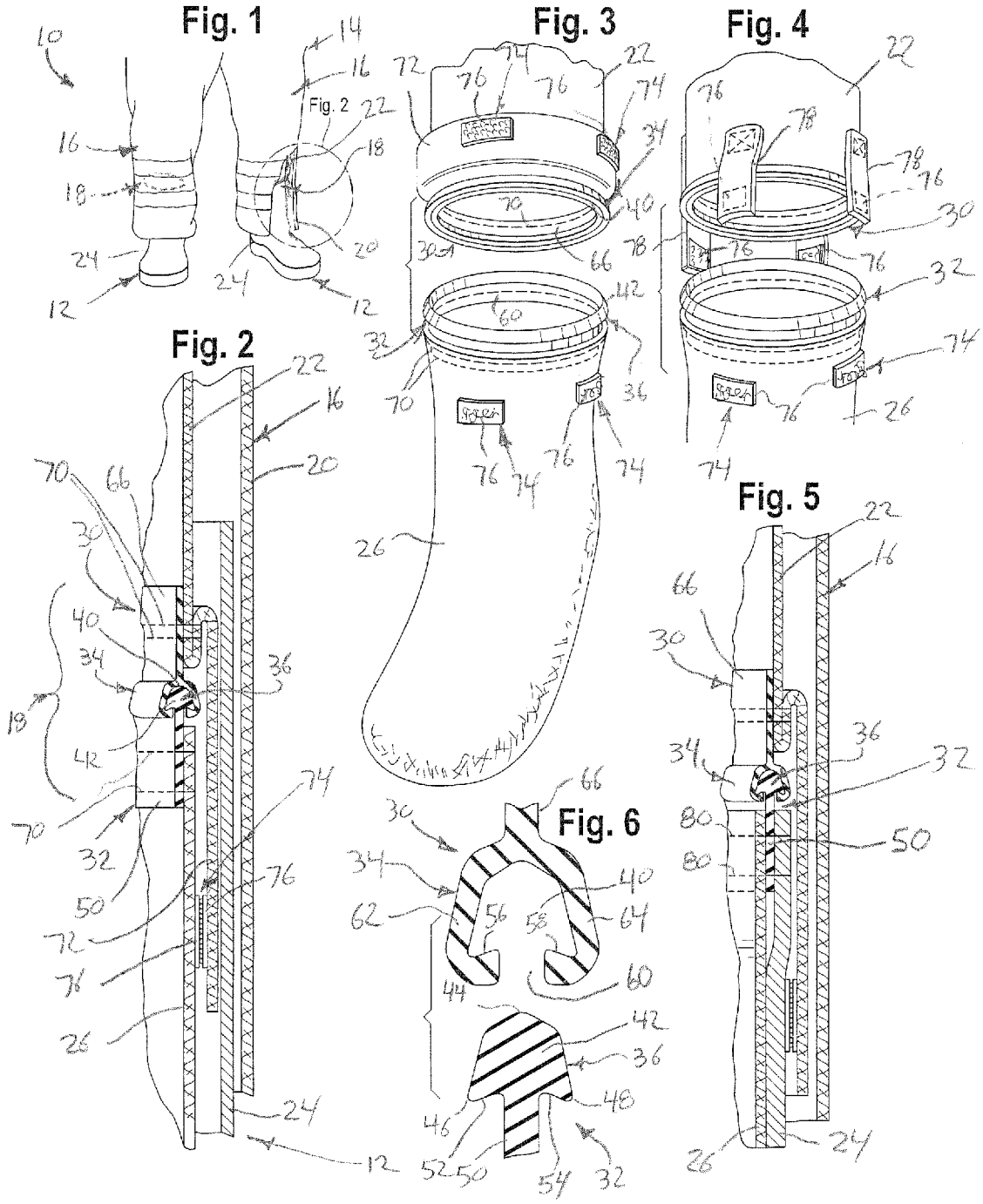
FIG. 1 is a perspective, partially broken, view showing the legs and feet of a firefighter or other emergency responder wearing protective garments having a gasket system embodying the present invention.
FIG. 2 is an enlarged view of the portion of FIG. 1 of the region indicated in FIG. 1.
FIG. 3 is an exploded perspective view of selected components of the protective garments and gasket system of FIGS. 1 and 2.
FIG. 4 is a view similar to FIG. 3 but showing another embodiment of selected components of the garments and gasket system.
FIG. 5 is a view similar to FIG. 2, but showing yet a further alternate embodiment of the garments and gasket system embodying the present invention.
FIG. 6 is an enlarged, exploded view of the gasket system of FIGS. 1-5.

As illustrated, a protective ensemble 10 of a type worn by firefighters and by emergency responders conforms to one or more National Fire Protection Association (NFPA) standards, as exemplified by NFPA 1971; NFPA 1976; NFPA 1951 USAR; NFPA 1977; NFPA 1999 EMS; NFPA 1991, 1992, 1994 HAZMAT. With reference to FIG. 1, portions of the protective ensemble 10 are shown as worn by a firefighter or other emergency worker or responder. The protective ensemble 10 includes a pair of protective boots 12, a protective garment 14 having two pant legs 16, and a gasket system, shown diagrammatically at 18 in FIG. 1, associated with each of the pant legs 16 and boots 12. The protective garment 14 may be any of a pair of protective pants, a pair of protective overalls, and/or a pair of protective coveralls.

With reference to FIGS. 1 and 2, the pant legs 16 include an outer shell 20, and a moisture/vapor barrier liner 22, which preferably conforms to at least NFPA 1971 (2007 Edition). The outer shell 20 may be made from any suitable fire resistant, thermal resistant and/or wear resistant (i.e., resistant to cuts, snaps, tears, and abrasions) material, some examples of which include Kevlar®, Nomex®, Basofil, PBI (polybenzimidazole), and PBO (poly(p-phenylene-benzobisoxazole)) materials. The moisture/vapor barrier liner 22 can be made of any suitable material that will be highly resistant to passage of liquid and vapor from the exterior of the garment, some examples of which include Crosstech® material or Neoprene®. Preferably, the moisture/vapor barrier liner is also highly resistant to chemicals such that it acts as a chemical barrier. One example of this material is supplied by W. L. Gore & Associates, Inc. under the CHEMPAK® trademark. Although not shown, the garment 14 and pant legs 16 can also include a thermal insulative liner made of any suitable thermal insulating material or construction, many of which are known.

Each of the boots 12 includes an outer boot 24 and a moisture/vapor barrier boot liner 26. The outer boot 24 can be made of any suitable material, including natural or synthetic leather, rubberized fabric and/or a suitable rubber material, such as a high temperature, flame retardant rubber, and the boot liner 24 can be made of any suitable material that will be highly resistant to the passage of liquid and vapor from the exterior of the boots, including any of the materials described above for the moisture/vapor barrier liner 22 of the pant legs 16.

As best seen in FIG. 2, each of the gasket systems 18 includes a first annular gasket or gasket member 30 fixed to the liner 22 of the corresponding pant leg 16, and a second annular gasket or gasket member 32 fixed to at least one of the outer boot 24 and boot liner 26, with the first and second gasket members 30 and 32 engaged with each other to form a vapor and moisture barrier seal when the leg of a wearer is received in the corresponding pant leg 16 and boot 12. In this regard, it is preferred that the gasket members 30 and 32 include engageable annular interlocks 34 and 36, respectively, that maintain engagement of the first and second gasket members. Each of the annular gasket members 30 and 32 is preferably made from a suitable rubber material, such as a high temperature, flame retardant rubber, and preferably one that can be molded or otherwise formed into the desired shape for the gasket member, while also providing sufficient rigidity for the interlock and sufficient resiliency to form the seal and allow the interlocks 34 and 36 to be repeatedly engaged and disengaged. In the illustrated embodiment, the interlocks 34 and 36 encircle a wearer's leg and engage each other to form the moisture/barrier seal, with the first annular interlock 34 having a downwardly opening annular channel 40 and the second annular interlock 36 being an upwardly directed annular bead 42 that is received in and interlocked with the channel 40, as best seen in FIGS. 2 and 6. The channel 40 and the bead 42 have cross-sectional shapes that define conforming surfaces that engage against each other to form the seal. In this regard, the bead 42 has an arrowhead cross-sectional shape with a somewhat pointed nose 44 that expands out to radially inner and radially outer edges 46 and 48, respectively, that are joined to a cylindrical mount wall 50 by a pair of downwardly facing annular shoulder surfaces 52 and 54, respectively. The channel 40 has an interior surface that conforms to the surface of the bead 42 and includes upwardly facing annular shoulder surfaces 56 and 58 and an annular mouth 60 for receiving the nose 44. The upwardly facing shoulder surfaces 56 and 58 engage the downwardly facing shoulder surfaces 52 and 54, respectively, of the bead 42 to retain the bead 42 within the channel 40. In this regard, preferably, each of the shoulder surfaces 52, 54, 56 and 58 is a frustoconical surface. The channel 40 is defined by a pair of annular resilient arms 62 and 64 that extend downwardly from a cylindrical mount wall 66. The arms 62 and 64 have sufficient resiliency to allow the bead 42 to be inserted into the channel 40 and interlocked therein when the nose 50 is forced upwardly into the mouth 60. The cylindrical walls 50 and 66 can be joined to their respective liners using any suitable means, including, for example, by lines of stitching 70, as shown in FIG. 2.

It should be appreciated that the downwardly opening channel tends to advantageously shed moisture like a shingle on a roof as the moisture is forced downwardly by gravity. Furthermore, it should be appreciated that the conforming cross-sectional shape of the channel 40 and the bead 42 help to ensure that the desired water/vapor seal is achieved in the gasket system 18. Furthermore, it should be appreciated that the frustoconical shoulder surfaces 52, 54, 56 and 58 tend to increase the resistance against separation when the gasket members 30 and 32 are attempted to be separated by pulling in the longitudinal direction.

As best seen in FIGS. 2 and 3, the liner 22 can include a cuff 72 that extends downwardly to overlay the boot liner 26, with releasable fasteners 74, such as Velcro or hook and loop fasteners 76 being provided on both of the liners 22 and 24 to help maintain the engagement of the gasket members 30 and 32. As best seen in FIG. 4, in another embodiment, the cuff 72 can be replaced and/or supplemented with individual strips or tabs 78 that are fixed to the liner 22 and include the fasteners 74,76. It will be appreciated that the tabs 78 could also be fixed to the boot liner 26 and extend upwardly to engage fasteners 76 on the liner 22.

FIG. 5 shows yet another alternate embodiment wherein the gasket member 32 is fixed to the outer boot 24. Again, any suitable method can be used to attach the gasket member 32 to the outer boot 24, including, for example, lines of stitching 80. Optionally, the boot liner 26 can either be removable or can also be fixed to the gasket member 32, as shown in FIG. 5.

It should be understood that while a preferred form for the gasket members 30 and 32 has been shown, other types of interlocks 34 and 36 with other interlocking shapes could be utilized in order to achieve the desired interlock between the gasket members 30 and 32. Furthermore, it should be appreciated that other shapes for the gasket members 30 and 32 could be utilized to achieve the desired moisture/vapor seal.

The invention claimed is:

1. A gasket system for use with a protective boot and a pant leg of a protective garment for a firefighter or other emergency worker, the boot including an outer boot and a moisture/vapor barrier liner, and the pant leg including an outer shell and a moisture/vapor barrier liner, the gasket system comprising:

a first gasket member fixed to the liner of the pant leg and defining a first annular interlock to encircle a wearer's leg received in the pant leg;

a second gasket member fixed to at least one of the outer boot and the boot liner and defining a second annular interlock to encircle a wearers leg received in the boot, the first and second interlocks engageable with each other to form a seal with a leg received in both the boot and the pant leg; and releasable fasteners on the pant leg and the boot, the fasteners having a first state wherein the fasteners on the pant leg are fastened to the fasteners on the boot to maintain engagement of the first and second annular interlocks, the fasteners having a second state wherein the fasteners on the pant leg are unfastened from the fasteners on the boot with the first and second annular interlocks engaged.

2. The gasket system of claim 1 wherein the second gasket member is fixed to the boot liner.

3. The gasket system of claim 1 wherein the second gasket is member fixed to the outer boot.

4. A gasket system for use with a protective boot and a pant leg of a protective garment for a firefighter or other emergency worker, the boot including an outer boot and a moisture/vapor barrier liner, and the pant leg including an outer shell and a moisture/vapor barrier liner, the pant leg extending from a proximal end to a distal end, the gasket system comprising:

a first gasket member fixed to the liner of the pant leg and defining a first annular interlock to encircle a wearer's leg received in the pant leg; and a second gasket member fixed to at least one of the outer boot and the boot liner and defining a second annular interlock to encircle a wearers leg received in the boot, the first and second interlocks engageable with each other to form a seal with a leg received in both the boot and the pant leg;

wherein the first annular interlock comprises an annular channel that receives the second annular interlock, the annular channel having an opening facing the distal end of the pant leg.

5. The gasket system of claim 4 wherein the first annular interlock includes an annular shoulder facing the proximal end of the pant leg and engageable with an annular shoulder of the second annular interlock facing the distal end to maintain engagement between the first and second gasket members.

6. The gasket system of claim 5 wherein the annular shoulders are defined by frustoconical surfaces.

7. For use by a firefighter or other emergency worker, in combination, a pant leg of a protective garment and a protective boot;

the pant leg comprising:

an outer shell for encasing a leg of a wearer, a moisture/vapor barrier liner for encasing the leg of a wearer, the liner surrounded by the outer shell, and a first gasket member fixed to the liner to encircle the leg of a wearer; and the boot comprising:

an outer boot, a moisture/vapor barrier liner within the outer boot, and a second gasket member fixed to at least one of the outer boot and the liner of the boot to encircle the leg of a wearer, the first and second gasket members defining interlocking, conforming annular surfaces that form a seal with the first and second gaskets engaged to each other; and releasable fasteners on the pant leg and the boot, the fasteners having a first state wherein the fasteners on the pant leg are fastened to the fasteners on the boot to maintain engagement of the first and second gasket members, the fasteners having a second state wherein the fasteners on the pant leg are unfastened from the fasteners on the boot with the first and second interlocks engaged.

8. The combination of claim 7 wherein the second gasket member is fixed to the liner.

9. The combination of claim 7 wherein the second gasket member is fixed to the outer boot.

10. For use by a firefighter or other emergency worker, in combination, a pant leg of a protective garment and a protective boot, the pant leg extending from a proximal end to a distal end;

the pant leg comprising:

an outer shell for encasing a leg of a wearer, a moisture/vapor barrier liner for encasing the leg of a wearer, the liner surrounded by the outer shell, and a first gasket member fixed to the liner to encircle the leg of a wearer; and the boot comprising:

an outer boot, a moisture/vapor barrier liner within the outer boot, and a second gasket member fixed to at least one of the outer boot and the liner of the boot to encircle the leg of a wearer, the first and second gasket members defining interlocking, conforming annular surfaces that form a seal with the first and second gasket members engaged to each other;

wherein the first gasket comprises an annular channel that receives an annular bead of the second gasket member, the annular channel having an opening facing the distal end of the pant leg to receive the bead when it is moved toward the proximal end of the pant leg, the channel and the bead defining said annular surfaces.

11. The combination of claim 10 wherein said annular surfaces comprise an annular shoulder surface on the first gasket member facing the proximal end of the pant leg, and an annular shoulder surface on the second gasket member facing the distal end of the pant leg, the shoulder surfaces interlocking to maintain engagement between the first and second gaskets.

12. The combination of claim 11 wherein the shoulder surfaces are frustoconical surfaces.

13. For use by a firefighter or other emergency worker, in combination, a pant leg of a protective garment and a protective boot;

the pant leg comprising:

an outer shell for encasing a leg of a wearer, a moisture/vapor barrier liner for encasing the leg of a wearer, the liner surrounded by the outer shell, and a first rubber gasket member fixed to the liner to encircle the leg of a wearer; and the boot comprising:

an outer boot, a moisture/vapor barrier liner within the outer boot, and a second rubber gasket member fixed to at least one of the outer boot and the liner of the boot to encircle the leg of a wearer, the first and second gasket members engaged with each other to form a seal with a leg received in the pant leg and the boot; and releasable fasteners on the pant leg and the boot, the fasteners having a first state wherein the fasteners on the pant leg are fastened to the fasteners on the boot to maintain engagement of the first and second gasket members, the fasteners having a second state wherein the fasteners on the pant leg are unfastened from the fasteners on the boot with the first and second interlocks engaged.

14. The combination of claim 13 wherein the first and second gasket members comprise annular seal surfaces that engage each other to form said seal.

15. The combination of claim 13 wherein the first and second gasket members comprise interlocking shoulders that engage against each other to maintain engagement of the first and second gasket members.

16. For use by a firefighter or other emergency worker, in combination, a pant leg of a protective garment and a protective boot, the pant leg extending from a proximal end to a distal end;

the pant leg comprising:

an outer shell for encasing a leg of a wearer, a moisture/vapor barrier liner for encasing the leg of a wearer, the liner surrounded by the outer shell, and a first rubber gasket member fixed to the liner to encircle the leg of a wearer; and the boot comprising:

an outer boot, a moisture/vapor barrier liner within the outer boot, and a second rubber gasket member fixed to at least one of the outer boot and the liner of the boot to encircle the leg of a wearer, the first and second gasket members engaged with each other to form a seal with a leg received in the pant leg and the boot, wherein the first gasket member comprises an annular channel and the second gasket member comprises an annular bead interlocked in the channel to maintain engagement of the first and second gasket members, the annular channel having an opening facing the distal end of the pant leg to receive the bead when the bead is moved toward the proximal end.

17. The combination of claim 13 wherein the first and second gasket members comprise engageable interlocks to maintain engagement of the first and second gaskets.

18. The gasket system of claim 1 wherein the fasteners are comprised of a plurality of fasteners spaced circumferentially from each other around the boot.

19. The gasket system of claim 7 wherein the fasteners are comprised of a plurality of fasteners spaced circumferentially from each other around the boot.

20. The gasket system of claim 13 wherein the fasteners are comprised of a plurality of fasteners spaced circumferentially from each other around the boot.

21. The gasket system of claim 4 wherein the second annular interlock has an arrowhead shaped cross section with a nose pointed toward the proximal end of the pant leg, and that expands from the nose to a pair of radially inner and radially outer annular edges that are joined to a cylindrical mount wall by a corresponding pair of annular shoulder surfaces facing the distal end of the pant leg.

22. The gasket system of claim 10 wherein the annular bead has an arrowhead shaped cross section with a nose pointed toward the proximal end of the pant leg, and that expands from the nose to a pair of radially inner and radially outer annular edges that are joined to a cylindrical mount wall by a corresponding pair of annular shoulder surfaces facing the distal end of the pant leg.

23. The gasket system of claim 16 wherein the bead has an arrowhead shaped cross sectional shape section with an upwardly pointed a nose pointed toward the proximal end of the pant leg, and that expands out from the nose to a pair of radially inner and radially outer annular edges that are joined to a cylindrical mount wall by a corresponding pair of downwardly facing annular shoulder surfaces facing the distal end of the pant leg.

* * * * *